US005261376A

United States Patent [19]

Kato et al.

[11] Patent Number: 5,261,376

[45] Date of Patent: Nov. 16, 1993

[54] TWO CYCLE INTERNAL COMBUSTON ENGINE WITH MULTIPLE CYLINDER FUEL INJECTION

[75] Inventors: Masahiko Kato; Seiichi Tanaka, both of Shizuoka, Japan

[73] Assignee: Yamaha Hatsudoki Kabushiki Kaisha, Japan

[21] Appl. No.: 907,540

[22] Filed: Jul. 2, 1992

[30] Foreign Application Priority Data

Jul. 4, 1991 [JP] Japan ..... 3-190668

[51] Int. Cl.[5] ..... F02D 41/18; F02D 41/22

[52] U.S. Cl. ..... 123/479; 123/480

[58] Field of Search ..... 123/478, 479, 480, 486, 123/488, 494, 73 A, 73 B, 73 C; 73/118.2

[56] References Cited

U.S. PATENT DOCUMENTS 4,461,260 7/1984 Nonaka et al. ..... 123/478
4,958,516 9/1990 Stiles et al. ..... 123/478
5,134,984 8/1992 Nonaka et al. ..... 123/494

FOREIGN PATENT DOCUMENTS 2-108826 4/1990 Japan .

*Primary Examiner*—Andrew M. Dolinar
*Attorney, Agent, or Firm*—Bacon & Thomas

[57] ABSTRACT

A two cycle internal combustion engine with multiple cylinder fuel injection constantly secures an accurate air intake volume and as a result provides good power characteristics through appropriate control of the fuel injection. In order to accomplish this, the pressure inside the crank chamber is detected by a pressure sensor and the timing of the scavenging stroke and the engine speed are detected by determining the crank angle. An ECU then determines amount of air intake from the engine speed and the crank chamber pressure prior to commencement of the scavenging stroke, and the amount of fuel injected from an injector is based on the amount of this air intake.

14 Claims, 5 Drawing Sheets

| N \ SPO | P 1 | P 2 | P 3 ----- | P j ----- | P m |
|---|---|---|---|---|---|
| N 1 | Q 11 | Q 12 | Q 13 ----- | Q 1j ----- | Q 1m |
| N 2 | Q 21 | Q 22 | Q 23 ---- | Q 2j ----- | Q 2m |
| N 3 | Q 31 | Q 32 | Q 33 ---- | Q 3j ---- | Q 3m |
| ⋮ | ⋮ | ⋮ | ⋮ | ⋮ | ⋮ |
| N o | Q j1 | Q j2 | Q j3 ---- | Q jj ----- | Q jm |
| ⋮ | ⋮ | ⋮ | ⋮ | ⋮ | ⋮ |
| N m | Q m1 | Q m2 | Q m3 ---- | Q mj ---- | Q mm |

TWO CYCLE INTERNAL COMBUSTON ENGINE WITH MULTIPLE CYLINDER FUEL INJECTION

BACKGROUND OF THE INVENTION

1. Field of the Invention

This invention concerns a two cycle internal combustion engine with multiple cylinder fuel injection which controls the amount of fuel injection based on the amount of air intake determined from the pressure in the crank chamber.

2. Description of Related Art

It is known to control the amount of fuel injected in fuel-injected internal combustion engines by detecting the amount of air intake. The method used in the past to detect the amount of air intake was to employ an air flow meter, but this increased the air intake resistance and caused changes in the operating characteristics of the engine. More recently, the amount of air intake has been computed using variations in the pressure inside the crank chamber. This type of arrangement is described in Japan Patent Hei 2-2-4785 (1990). The air intake volume is computed based on the difference between the pressure in the crank chamber immediately prior to the scavenging port opening (SPO) and the pressure in the crank chamber when the scavenging port was closed (SPC). The amount of fuel injection is controlled based on this amount of air intake.

In this prior art example, the rapid change in the pressure inside the crank chamber just after the SPO makes it possible to detect the amount of intake air accurately in order to maintain an optimal air/fuel mixture.

However, in a multiple cylinder type of internal combustion engine, the configuration of the exhaust system could cause a pressure return to the crank chamber due to the blow-down pressure of cylinders between the SPO and the SPC. Also, pressure wave pulses or changes in back pressure in the exhaust system could affect the SPC and make it impossible to determine the difference between the SPO and the SPC, and the expulsion of the combustion gas from the cylinder could vary over the entire operating range, causing the air intake to differ. Therefore, the type of arrangement described in the above-mentioned Japan Patent Hei 2-2-4785 would not be able to accurately detect the air intake volume for a two cycle multiple cylinder internal combustion engine.

SUMMARY OF THE INVENTION

It is therefore an objective of the invention to provide a two cycle internal combustion engine with multiple cylinder fuel injection which makes it possible to constantly and accurately determine the air intake volume and, as a result, to appropriately determine the optimum amount of fuel injection to provide optimal engine performance characteristics.

In order to achieve this objective, according to a preferred embodiment of the invention, a fuel injection arrangement is provided of the type in which the crank chamber pressure is used to determine the air intake volume, and the air intake volume is used to control the amount of fuel injected through a fuel injection means, the arrangement including a pressure detection means which detects the internal pressure in the crank chamber, a timing detection means which detects the timing at the commencement of the scavenging stroke and, uniquely, an engine speed (rpm) detection means which detects the engine speed. An air intake determination means determines the amount of air intake based on both the engine speed and the crank chamber pressure just prior to the commencement of the scavenging stroke.

The reason for providing the air intake volume determination system with engine speed detection means is that the SPO is relatively insensitive to blow-down pressure or to pressure wave pulses in the exhaust system, but the extent to which there is variation in the amount of air intake from these effects is affected by the magnitude of the engine speed. Therefore, the amount of air intake is not determined by using the SPO and the SPC to determine crank chamber pressure differences. Instead, the SPO, which is fairly insensitive, and the engine speed are used in order to determine the amount of air intake. Based on the detection of the SPO and the engine speed, the amount of air intake can be determined constantly and accurately.

DETAILED DESCRIPTION OF THE PREFERRED EMBODIMENTS

Figure 1:
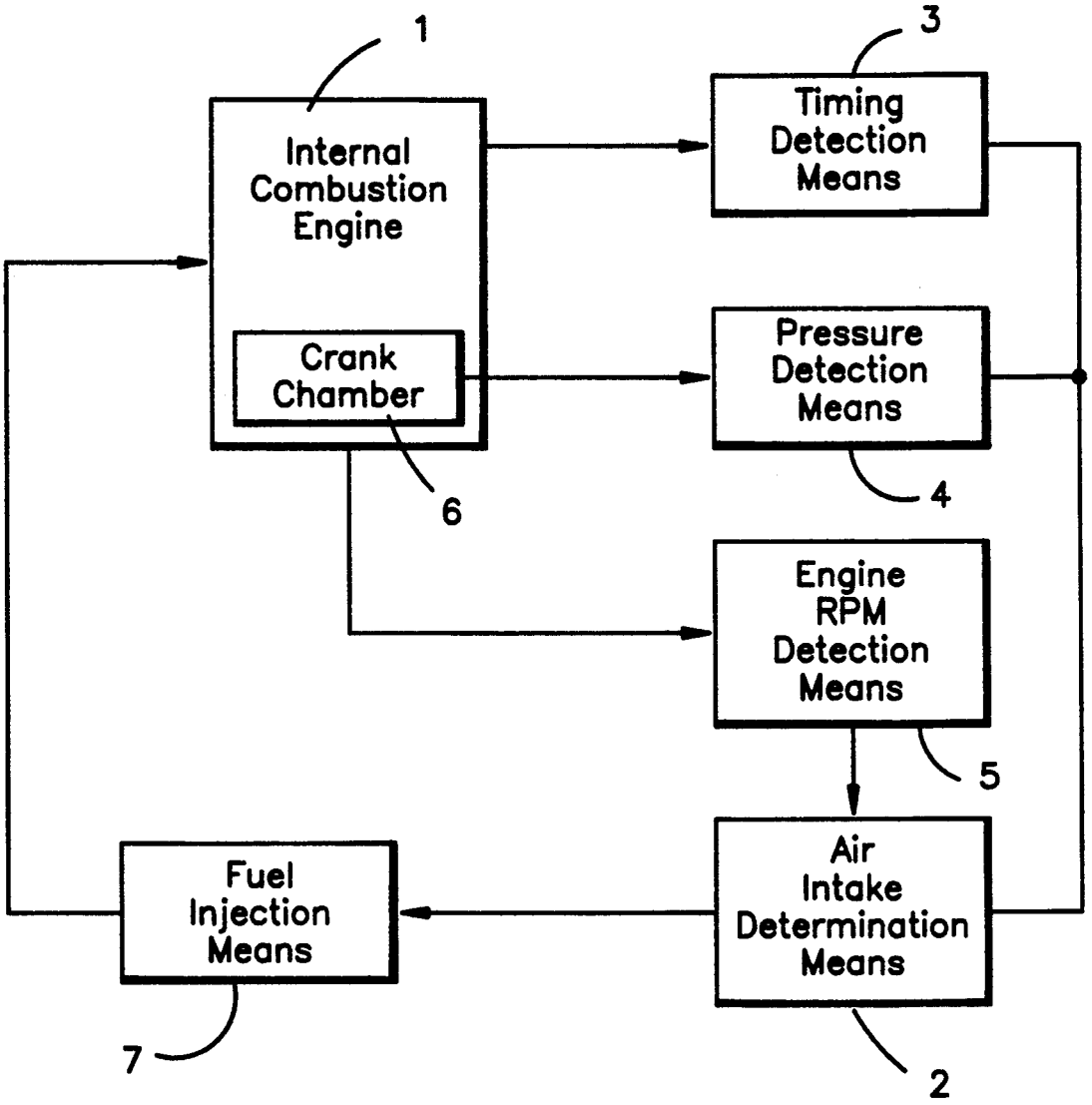
FIG. 1 is a block diagram showing a fuel injection control arrangement for a two-cycle internal combustion engine constructed in accordance with the principles of a preferred embodiment of the invention.

FIG. 1 is a block diagram illustrating a preferred fuel injection arrangement in which the crank chamber pressure of an internal combustion engine is used to determine the air intake volume and control fuel injection, as follows: The air intake is determined by an air intake determination means 2 connected to a timing detection means 3, a pressure detection means 4, and an engine speed (e.g., rpm) detection means 5. The pressure detection means detects the internal pressure in the crank chamber 6. The timing detection means 3 detects the timing at the commencement of the scavenging stroke, and the engine speed detection means 5 detects the engine speed in known fashion. The air intake determination means 2 then computes the amount of air intake from the engine rpm and crank chamber pressure detectors just prior to the commencement of the scavenging stroke, as determined by the timing detection means, in order to control fuel injection means 7.

Figure 2:
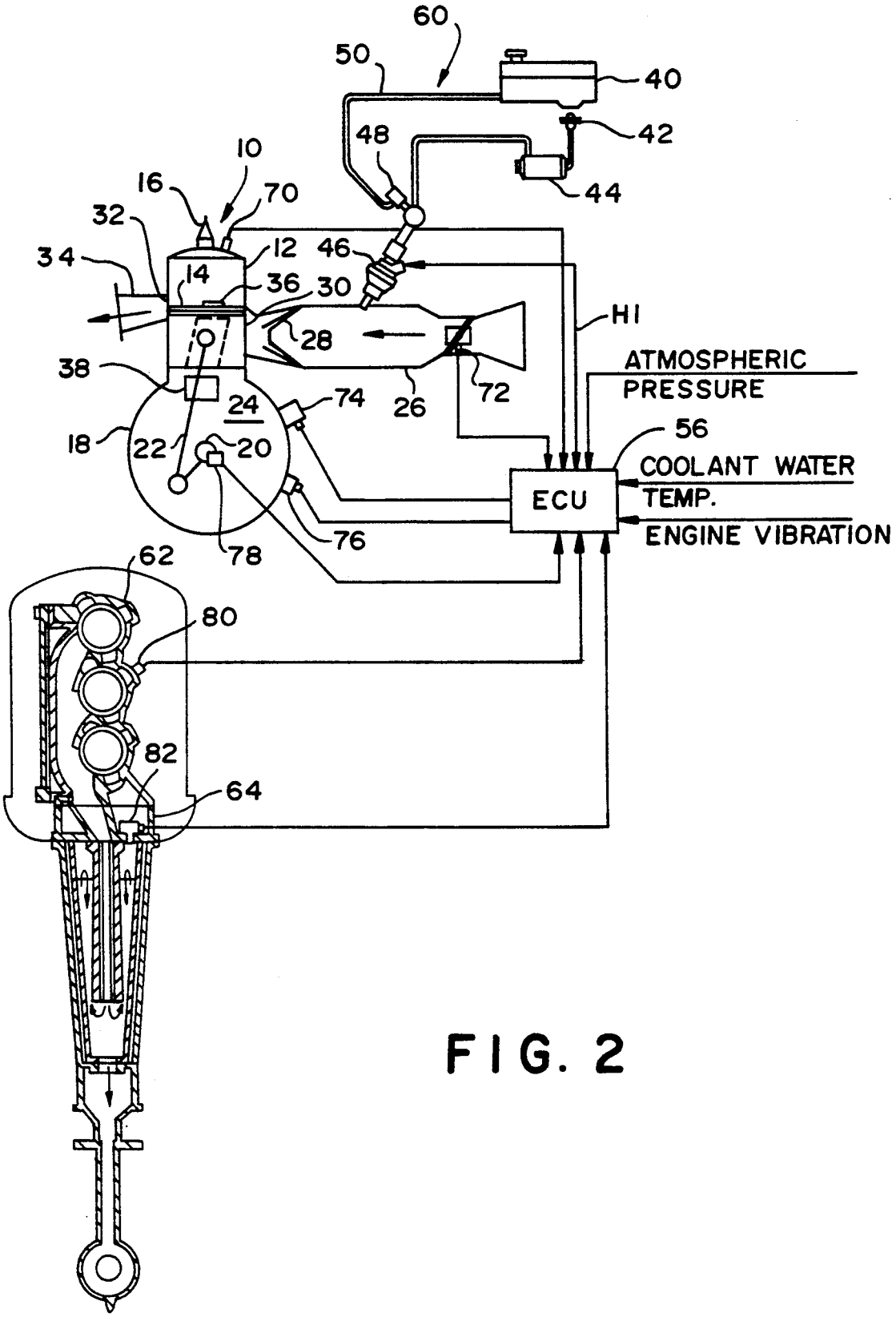
FIG. 2 is a schematic drawing showing the manner in which the arrangement of FIG. 1 is applied to a specific internal combustion engine structure.

FIG. 2 is a diagram of a two cycle internal combustion engine 10 using multiple cylinder fuel injection. Pistons 14 are inside cylinders 12 and are linked to crankshaft 20, which runs through the crank chamber 24 inside crankcase 18, via control rods 22, as is well-known in the art.

Air intake ports 30 are present in the wall surfaces of cylinders 12 and are connected to air intake lines 26 via reed valves 28. Exhaust ports 32 and scavenging ports 36 are established in the walls of cylinders 12. The exhaust ports 32 are connected to exhaust pipe 34 and the scavenging ports 36 are linked to the crank chamber 24 by scavenging passages 38. At the top of the combustion chamber are spark plugs 16.

Reference number 60 represents the fuel injection system. This fuel injection system is composed of fuel tank 40, strainer 42 which removes foreign material from the fuel, electromagnetic fuel supply pump 44, injector 46 which injects fuel into the air intake passage, and pressure regulator 48 which regulates the fuel pressure between fuel pump 44 and injector 46, and which, when the fuel pressure rises above a certain level, returns fuel through pipe 50 to the above mentioned fuel tank 40.

Reference number 56 represents the electronic control unit (ECU) which, based on the above-described SPO and the engine speed, determines the amount of air intake and the optimal amount of fuel which needs to be injected. The output from the various sensors described below are input into this ECU.

Reference number 70 is a pressure sensor which detects the pressure inside the combustion chamber, 72 is a throttle angle sensor which detects the throttle angle, 74 is a pressure sensor which detects the pressure inside the crank chamber, 76 is an air intake temperature sensor which detects the temperature of the air taken into the crank chamber 24, 78 is the crank angle sensor, 80 is an engine temperature sensor which detects the temperature of the cylinder body 62, and 82 is a back pressure sensor which detects the back pressure inside the exhaust manifold 64.

In addition to receiving detection signals from the above sensors, ECU 56 also receives inputs from various other detectors, including atmospheric pressure, coolant water temperature, and engine vibration detectors.

ECU 56 operates according to a program established in ROM and controls the amount of fuel injection based on its computation of the amount of air intake, as determined from the various detection signals, by supplying electricity to the above described fuel injector 46 for a time interval which is based on amount of fuel computed. The electrical power-supply interval to each of the injectors is an output in the form of the injector operation signal H1.

Figure 3:
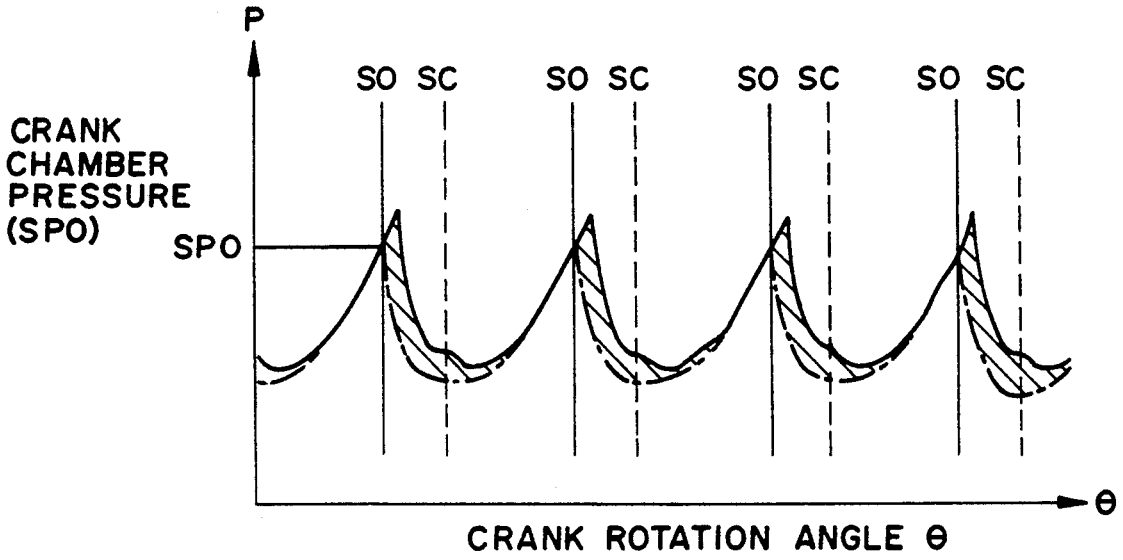
FIG. 3 is a graph of the relationship between crank angle and crank chamber pressure in an engine of the type shown in FIG. 2.

The reason why the air intake volume can be accurately determined from the SPO and the engine speed will now be explained:

During engine operation, the pressure inside the crankcase varies as shown by the solid line in FIG. 3. FIG. 3 is a graph of the relationship between the crank rotation angle and the crank chamber pressure. The notations SO and SC are the time intervals of the scavenging port 36 opening and closing, respectively. As a result of close study by the inventors, it has been found that there is a variation in the SPC in multiple cylinder internal combustion engines due to blow-down pressure from other cylinders, blow-down pressure for the same cylinder into the crankcase, and back pressure changes and pressure wave pulses in the exhaust system which cause variations in the crank chamber pressure. The area affected by the pressure is shown by the shaded area in the figure.

Figure 4:
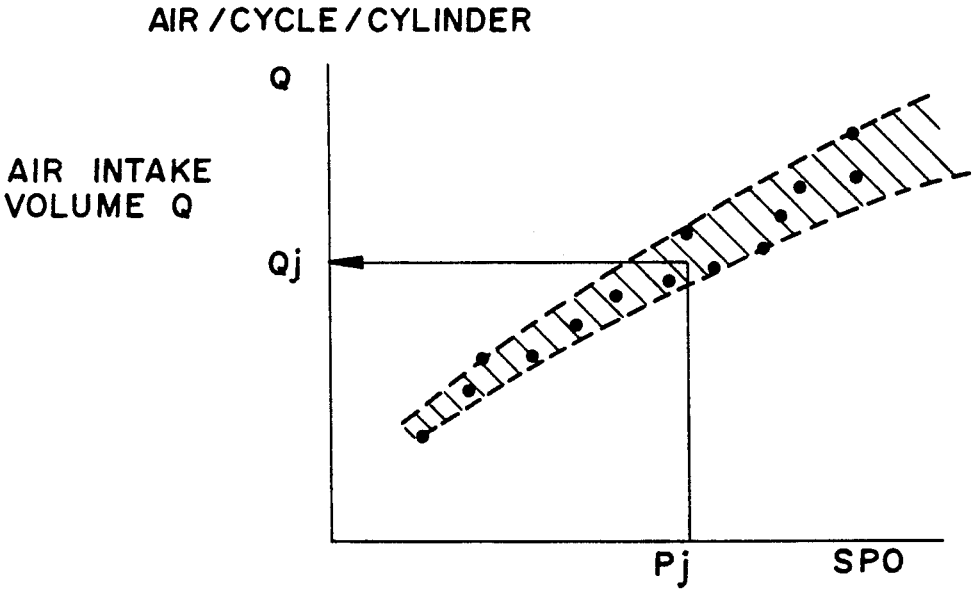
FIG. 4 is a graph of the relationship between SPO and air intake volume in an engine of the type shown in FIG. 2.

To solve this problem, the relationship between the air intake amount (volume) and the SPO, which is fairly insensitive to the above factors, was investigated by the inventors. As shown in FIG. 4, it was found that the air intake volume varied as shown by the shaded area, so the SPO could not be used by itself to determine the air intake volume. However, because the frequency of the exhaust pulses, etc., is determined by the engine speed, it was realized that if both the SPO and engine speed were determined at the same time, it would be possible to use the determinations to compute the air intake volume.

Figures 5, 6:
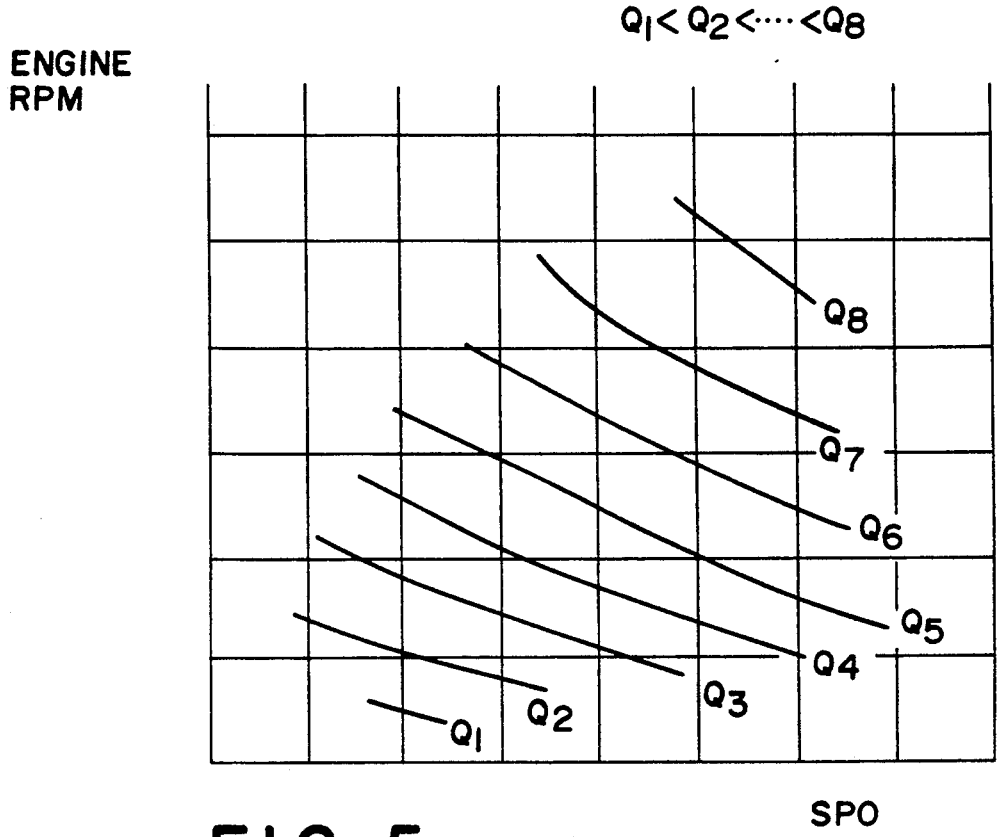
FIG. 5 is a graph of the relationship of air intake volume with respect to SPO and engine speed in an engine of the type shown in FIG. 2.
FIG. 6 is a three dimensional map based on the graph of FIG. 5.

At this point, as a result of the inventor's investigation of the relationship between the air intake volume and the SPO and engine speed, the characteristics shown in FIG. 5 were obtained. The air intake volume can be accurately determined from the SPO and the engine speed, based on the characteristics shown in FIG. 5.

FIG. 6 is a three dimensional map of FIG. 5. This map is pre-set in the memory region of the ROM for ECU 56, as will be described below.

Figure 7:
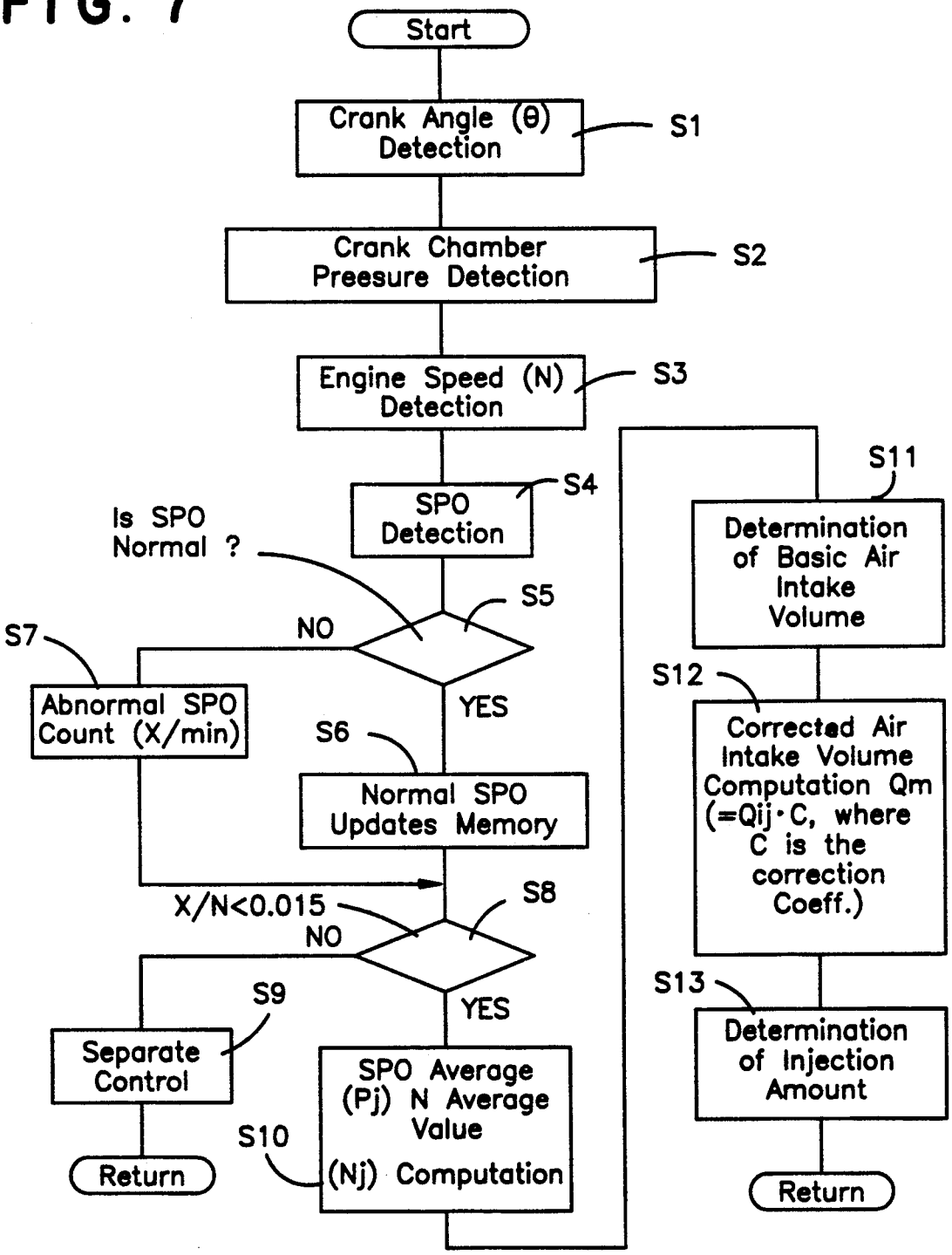
FIG. 7 is a flow chart explaining the operation of the engine of FIG. 2.

The operation of the preferred embodiment will be described according to the processing program set in the ROM of the above-mentioned ECU 56. FIG. 7 shows the processing program for each of the time interval steps.

First, during step S1, the crank angle is detected when the crank angle signal is read in from crank angle sensor 78. In step S2, the pressure inside the crank chamber is detected when the signal from pressure sensor 74 is read. In step S3, the engine speed N is detected by, for example, measuring the pulse interval of the crank angle sensor read in S1. At step S4, the timing SO (see FIG. 3) just prior to the opening of the scavenging port in each cycle is determined by the crank angle detected in S1. At this time, the pressure inside the crank chamber, the SPO, and the engine rpm (N) are detected and these values are temporarily memorized in the CPU.

When the engine is operating at a high number of rpm's, a discrepancy develops between the value detected by the crank angle detector and the actual crank angle. Therefore, in order to prevent a mis-determination of the SPO value, it is preferable to make a correction for the crank angle discrepancy ahead of time in determining the (SO) timing.

Moving to step S5, a determination is made as to whether the above SPO is within a normal range, since there are cases when it would be abnormal, such as when there is a back-fire. Since an accurate air intake amount cannot be determined from an abnormal SPO, it is desirable to eliminate any abnormal SPO values at this time. If the SPO is determined to have been an accurate value, the program moves to step S6, where the SPO and the engine speed (N) are written into a specific memory location in RAM. This memory region is set up to retain 4-cycles of SPO and engine speed data. The region is progressively updated by adding the newest cycle data and discarding the oldest cycle data.

If there is a determination in step S5 that the SPO value is an abnormal one, the value is not placed in the RAM memory region and the program moves directly to step S8, and a count is commenced per unit time (X/min) of how many abnormal values have been returned. The occurrence frequency of these abnormal values (X/N) is then computed and, if the occurrence frequency X/N is under 0.015, then a determination is made that the rate of abnormality is low and the engine is operating normally. This allows processing to continue from step S10. On the other hand, if the X/N occurrence frequency is 0.015 or greater, then a determination is made that something is wrong with either the engine or a sensor. Step S9 deals with the abnormal state by performing processing to determine the amount of air intake. When the engine returns to normal, i.e., after the abnormal value occurrence frequency X/N returns to under 0.015, then the program returns to step S10 and the following steps.

In step S10, the average of the 4 cycles memorized during step S6 is computed as Pj, and the average engine speed is computed as Nj. The reason for performing this averaging operation is that even when the engine is operating normally, there is some deviation in the SPO values, so it is desirable to average the data from several cycles in order to determine the SPO with more precision. However, if too few cycles are averaged, the precision of the SPO falls, and if too many are averaged, then the response characteristics decline, so it is preferable to average just a few cycles.

Moving to step S11, a determination of the basic air intake volume Qij is made based on the three dimensional map shown in FIG. 6, the 4-cycle SPO average Pj and the engine rpm average Nj. Since the intake volume varies somewhat depending upon the atmospheric pressure and the temperature, a correction coefficient (C) is determined in step S12 based on input from the various sensors, and correction coefficient C is multiplied by the above mentioned basic air intake volume Qij to obtain the corrected air volume QM.

In step S13, a determination of the amount of fuel to be injected is made in order to optimize air/fuel ratio. This is based on the corrected air volume QM. The amount injected is controlled by the time interval of power supply to the above described fuel injectors. The electrical power supply time interval is also affected by the detected values for engine temperature, coolant water temperature, cylinder pressure, atmospheric pressure, engine vibration and back pressure, etc., in known fashion.

Upon determining the amount of fuel to be injected, the electrical feed signal H1 to the injector is applied intermittently at the optimal interval in synch with the crank angle $\theta$ according to a program pre-established for the ECU 56.

The result of the above is that ECU 56 makes a constant determination of the air volume and uses it as the basis for fuel injection. Internal combustion engines which are equipped with such an ECU exhibit excellent operating characteristics.

In the above example, the crank angle detection was made just prior to the start of the scavenging stroke, but as stated in the above-referenced Japan Patent Hei 2-4785, a hole passing through the piston and the cylinder, and opening through both just prior to the opening of the scavenging port, may be used to determine the timing based on the opening of the hole, at which time the crank chamber pressure may be detected.

In summary, therefore, the above-described invention determines the air intake volume by detecting the values for the SPO and engine speed in order to constantly and accurately determine the air intake volume, and as a result, allows the provision of fuel injected two-cycle engines in which the amount of fuel injection is optimally controlled to provide better operating characteristics. However, although the above-described embodiment is especially suited to accomplish this determination, it is to be understood that variations of the above are also intended to be included within the scope of the invention. Consequently, it is intended that the invention not be limited by the above description, but that it be defined solely by the appended claims.

We claim:

1. An arrangement for controlling an amount of fuel injected by a fuel injection means in a multiple cylinder two-cycle internal combustion engine having a crank chamber and fuel injection, comprising:

pressure detection means for detecting an internal pressure in the crank chamber;

timing detection means for detecting a timing of a commencement of a scavenging stroke;

engine speed detection means for detecting an engine speed;

air intake determination means for determining an amount of air intake based on the engine speed and the crank chamber pressure just prior to the commencement of the scavenging stroke as detected by the timing detection means;

means for controlling fuel injection based on said determination; and an electronic control unit, wherein said electronic control unit includes said air intake determination means, wherein said pressure detection means, timing detection means, and engine speed detection means are connected as inputs to said electronic control unit, and wherein said electronic control unit further includes a ROM in which is stored a three dimensional map of a predetermined relationship between air intake volume, a scavenging port opening crank chamber pressure, and the engine speed, for use in computing the air intake volume based on the determinations made by said pressure detection means, timing detection means, and engine speed detection means.

2. An arrangement as claimed in claim 1, wherein said timing detection means comprises a crank angle sensor.

3. An arrangement as claimed in claim 2, wherein said engine speed detection means comprises means for measuring a pulse interval of the crank angle sensor.

4. An arrangement for controlling an amount of fuel injected by a fuel injection means in an internal combustion engine having a crank chamber and fuel injection, comprising:

pressure detection means for detecting an internal pressure in the crank chamber;

timing detection means for detecting a timing of a commencement of a scavenging stroke;

engine speed detection means for detecting an engine speed;

air intake determination means for determining an amount of air intake based on the engine speed and the crank chamber pressure just prior to the commencement of the scavenging stroke as detected by the timing detection means; and means for controlling fuel injection based on said determination, wherein said timing detection means comprises a crank angle detector and said engine speed detection means comprises means for measuring a pulse interval of the crank angle detector, and further comprising means for correcting for discrepancies, predetermined to occur at or above certain engine speeds, between a value detected by the crank angle detector and an actual crank angle.

5. An arrangement for controlling an amount of fuel injected by a fuel injection means in an internal combustion engine having a crank chamber and fuel injection, comprising:

pressure detection means for detecting an internal pressure in the crank chamber;

timing detection means for detecting a timing of a commencement of a scavenging stroke;

engine speed detection means for detecting an engine speed;

air intake determination means for determining an amount of air intake based on the engine speed and the crank chamber pressure just prior to the commencement of the scavenging stroke as detected by the timing detection means; and means for controlling fuel injection based on said determination, wherein said air intake determination means comprises a RAM and means for writing scavenging port opening crank chamber pressure data and engine speed data into the RAM, said RAM comprising means for storing a plurality of cycles of scavenging port opening crank chamber pressure and engine speed data, said air intake determination means further comprising means for updating the data, and means for averaging the data for use in computing the air intake.

6. An arrangement as claimed in claim 5, wherein a number of said cycles over which the engine speed and scavenging port opening crank chamber pressure data is averaged is four.

7. An arrangement for controlling an amount of fuel injected by a fuel injection means in an internal combustion engine having a crank chamber and fuel injection, comprising:

pressure detection means for detecting an internal pressure in the crank chamber;

timing detection means for detecting a timing of a commencement of a scavenging stroke;

engine speed detection means for detecting an engine speed;

air intake determination means for determining an amount of air intake based on the engine speed and the crank chamber pressure just prior to the commencement of the scavenging stroke as detected by the timing detection means;

means for controlling fuel injection based on said determination; and means for determining whether a scavenging port opening crank chamber pressure data is abnormal, means for determining an occurrence frequency of abnormal scavenging port openings, and means for determining whether the occurrence frequency is indicative of abnormal engine operation.

8. A method of controlling an amount of fuel injected by a fuel injection means in an internal combustion engine having a crank chamber, comprising the steps of:

(a) detecting an internal pressure in the crank chamber;

(b) detecting a timing at a commencement of a scavenging stroke;

(c) detecting an engine speed;

(d) determining an amount of air intake from the engine speed and the crank chamber pressure at a predetermined timing; and (e) controlling fuel injection based on said determination, and further comprising the steps of writing a scavenging port opening crank chamber pressure value and the engine speed into a RAM, averaging the data over a plurality of cycles to obtain a scavenging port opening crank chamber pressure average and a four cycle engine speed average, and basing the determination made in step (d) on said averages.

9. A method as claimed in claim 8, wherein said engine is a multiple cylinder two cycle engine.

10. A method as claimed in claim 8, wherein step (d) is carried just prior to commencement of the scavenging stroke.

11. A method as claimed in claim 8, wherein step (b) comprises the step of detecting a crank angle by means of a crank angle sensor.

12. A method as claimed in claim 11, wherein step (c) comprises the step of measuring a pulse interval of the crank angle sensor.

13. A method as claimed in claim 8, wherein said averages are four cycle averages.

14. A method as claimed in claim 8, wherein step (d) comprises the step of mapping the averages onto a three-dimensional map, stored in ROM, of a relationship between scavenging port opening crank chamber pressures, engine speed, and air intake volume, in order to determine the air intake volume.

* * * * *